United States Patent [19]

Salaman

[11] Patent Number: 5,001,316

[45] Date of Patent: Mar. 19, 1991

[54] PUSH SWITCH WITH PRINTED TERMINAL BOARD

[75] Inventor: Mauricio Salaman, Colonia Del Valle, Mexico

[73] Assignee: Kamada II, Inc., Dearborn Heights, Mich.

[21] Appl. No.: 506,117

[22] Filed: Apr. 9, 1990

[51] Int. Cl.[5] ..... H01H 13/56

[52] U.S. Cl. ..... 200/527; 200/526; 200/11 DA; 200/292; 200/303

[58] Field of Search ..... 200/292, 523, 526, 527, 200/528, 303, 11 D, 11 DA

[56] References Cited

U.S. PATENT DOCUMENTS

| | | | |
|---|---|---|---|
| 3,204,067 | 8/1965 | Brown | 200/527 |
| 3,694,603 | 9/1972 | Congelliere | 200/526 |
| 3,801,753 | 4/1974 | Szymber | 200/11 DA |
| 4,175,222 | 11/1979 | Buttner | 200/528 |
| 4,506,124 | 3/1985 | Rose et al. | 200/528 |
| 4,625,084 | 11/1986 | Fowler et al. | 200/11 DA |
| 4,891,476 | 1/1990 | Nation et al. | 200/527 X |
| 4,906,808 | 3/1990 | Burgess et al. | 200/527 |

*Primary Examiner*—Ernest G. Cusick

*Attorney, Agent, or Firm*—Robert G. Mentag

[57] ABSTRACT

An electrical switch including a housing having a planar electrically insulating interior surface on which is seated a printed circuit terminal board that has at least a pair of electrolytically deposited electrical terminals, and a rotatable contact plate having contacts for electrically connecting and disconnecting said terminals in a predetermined sequence, and a push-button stepping means operatively connected to the contact plate for selective rotation of said contact plate.

5 Claims, 5 Drawing Sheets

PUSH SWITCH WITH PRINTED TERMINAL BOARD

BACKGROUND OF THE INVENTION

1. Technical Field

The field of art to which this invention pertains may be generally located in the class of devices relating to electrical switches. Class 200, Electricity, Circuit Makers and Breakers, United States Patent Office Classification, appears to be the applicable general area of art to which the subject matter similar to this invention has been classified in the past.

2. Background Information

It is known in the Electrical Switch art to provide push-button switches for making and breaking circuits handling moderate current loads for a variety of applications. Push-button switches are used in various products, such as automobiles and other vehicles, tools, electrical appliances, and the like. In the automotive field, push-button switches are used for energizing and de-energizing engine controls systems, various lights, climate controls, and the like. Examples of prior art push-button switches adapted for the aforementioned uses are disclosed in U.S. Pat. Nos. 3,204,067; 3,694,603 3,883,710; 4,175,222; 4,288,670 and 4,308,440.

A problem encountered in the prior art push-button switches is that they employ expensive and fragile stamped metal terminals of various shapes. These terminals are of a complex design and due to their smallness, create a very difficult situation for crimping the same to the switch wire leads. As a result, instances of wire detachment from the terminals in a switch assembly occur, and cause switch failures. Furthermore, once the prior art stamped metal terminals are assembled to their respective wire leads, the terminal and wire assembly so formed is difficult to assemble into the switch housing, and this is especially so in the design of a three-wire switch. Also, the terminal and wire assemblies can become very tangled in the assembly line containers and cause an inherent delay and loss of production assembly time, due to the time it takes to untangle the same. The aforedescribed stamped metal terminals also have an inherent problem of milli-volt drop, during the operation of push-button switches employing such terminals, resulting in low efficiency switches. The prior art use of fragile stamped metal terminals also requires the use of various types of locating pins in the switch housing, to restrain them from movement in the switch housing, and maintain their position in the housing.

SUMMARY OF THE INVENTION

The present invention is directed to a push-button type switch which is adapted to switch moderate current loads in a variety of applications such as in vehicles, tools and electrical appliances. The switch of the present invention is adapted to sequentially open and close a circuit or to sequentially switch power between two alternate circuits. The push-button switch of the present invention includes a housing which comprises a lower portion, and an upper portion operatively mounted on said lower portion. The housing lower portion is provided with an interior compartment, which has a electrically insulating interior planar surface on which is operatively mounted a printed circuit terminal board. The printed circuit terminal board includes an electrically insulating base board which has an upper planar surface on which is electrolytically deposited at least a first and a second electrical terminal. The said terminals are spaced apart by co-planar insulating material deposited on the base board planar upper surface so as to provide an overall planar surface. A planar, circular, electrically conductive contact plate has a plurality of contact members which are disposed in a first position over the printed circuit terminal board to electrically connect the first and second electrical terminals. The contact plate is adapted to be rotated to a contacting second position to electrically disconnect the first and second terminals. A push-button stepping means is operatively connected to the contact plate to sequentially rotate the contact plate to said first and second positions.

The printed circuit terminal board employed in the present invention eliminates the need for very expensive and very fragile stamped metal terminals heretofore used in the prior art push-button switches. Said stamped metal terminals are usually of a complex design and due to their smallness create a very difficult problem for crimping the same to suitable electric wire leads. Consequently, there exists a problem with the use the aforementioned stamped metal terminals which results in wire detachment from the terminals in the switch assembly and consequent switch failure. The push-button switch of the present invention overcomes the last described problems encountered in the use of stamped metal terminals.

A further problem that arises with the use of the prior art stamped metal terminals is that once they are assembled to the electrical wire leads, the terminal and wire assembly is difficult to assemble into the switch housing, and especially in a three-wire design. Also the assembled terminal and electrical wire assemblies become very tangled in the assembly line containers for the same, which tangling can cause inherent delays and losses of production assembly time, due to the time that it takes to untangle such combinations of the terminals and electrical wires. This last mentioned problem in the use of the prior art stamped metal terminals is eliminated by the use of the printed circuit terminal board employed in the switch of the present invention.

The push-button switch of the present invention employs fewer and less complex components in its construction and arrangement, and accordingly, during the assembly process of its parts such operation can be carried out in a much shorter time then heretofore possible in the assembly of the prior art push-button switches, which feature results in a significant cost reduction.

The printed circuit terminal board of the present invention provides an extensive planar operating surface area between the contact plate and the printed terminal board face, and accordingly, there is provided a major reduction in the problem of milli-volt drop during operation of a switch made in accordance with the principles of the present invention as compared to push-button switches employing the use of loose stamped terminals, which must be individually secured in the switch housing. The printed circuit terminal board employed in the switch of the present invention thus resolves a very serious design problem, and it provides increased life and operating efficiency of the switch because of the employment of the printed circuit terminal board.

DESCRIPTION OF THE PREFERRED EMBODIMENTS

Figure 1:
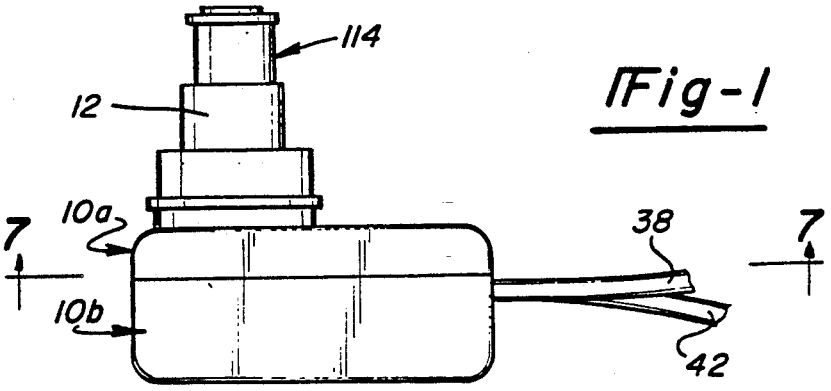
FIG. 1 is a side elevation view of an assembled switch made in accordance with the principles of the present invention.
Figure 2:
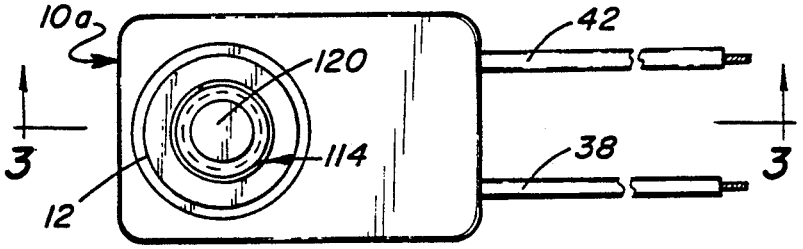
FIG. 2 is a top plan view of the switch structure shown in FIG. 1.

Referring now to the drawings, and in particular to FIG. 1, the switch of the present invention comprises a housing which includes an upper portion, generally designate by the numeral **10*a* and a lower portion, generally designated by the numeral 10*b*. The upper cylindrical portion 12 of the housing upper portion 10*a* may be provided with a threaded periphery for mounting the switch in the product in which the switch is to be used. The housing portions 10*a* and 10*b* may be made from any suitable electrical insulating material, including synthetic polymeric materials, and the like, as for example a plastic material available on the market under the trademark "ACETAL". As best seen from FIGS. 3-5, the housing lower portion 10*b* is provided with a substantially rectangular, interior compartment 14 which is open at the upper end thereof, and which is provided with a planar interior bottom surface 16**.

Figure 3:
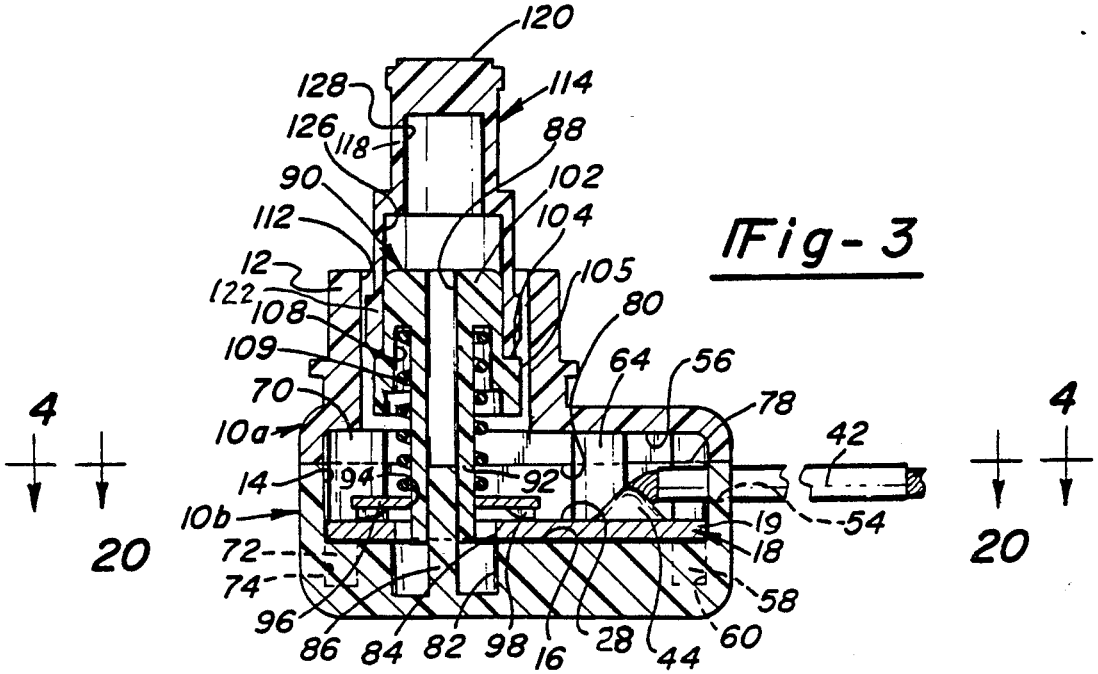
FIG. 3 is an elevation section view of the switch structure illustrated in FIG. 2, taken along the line 3—3 thereof, and looking in the direction of the arrows.
Figure 20:
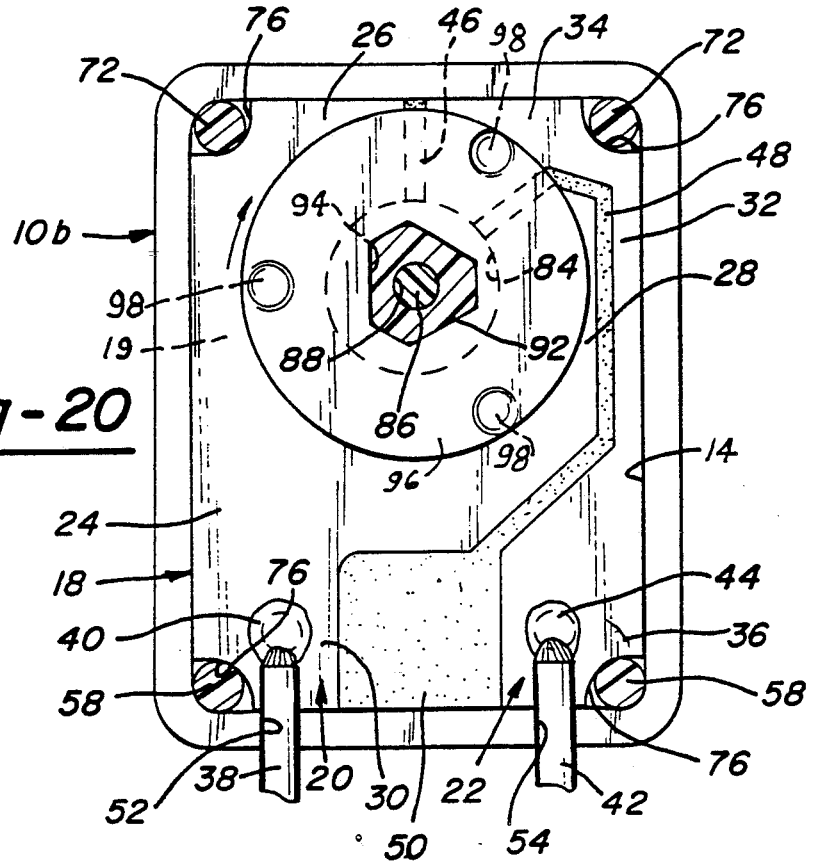
FIG. 20 is a horizontal section view of the switch structure illustrated in FIG. 3, taken along the line 20—20 thereof, with parts removed and showing a two-wire printed circuit board, and looking in the direction of the arrows.

As shown in FIGS. 3 and 20, a printed circuit terminal board generally indicated by the numeral 18, is seated in the compartment 14 on the bottom surface 16. The printed circuit terminal board 18 is generally rectangular in plan view, as shown in FIG. 20, and it includes a base board 19 which has parallel upper and lower surfaces. The base board 19 for the printed circuit terminal board 18 is made from a suitable electrically insulating material, as for example a fiberglass material. A suitable electrically insulating material for the printed circuit terminal board 18 is any epoxy, glass, paper composite material.

As illustrated in FIG. 20, the base board 19 of the printed circuit terminal board 18 is provided on its upper planar surface with a pair of electric terminals, generally indicated by the numerals 20 and 22, which are deposited electrolytically thereon. The conductive material for the electric terminals 20 and 22 may comprise any suitable conductive material capable of being deposited electrolytically on the base board 19, as for example, silver, copper, and the like. As viewed in FIG. 20, the electric terminal 20 is substantially J-shaped in plan view, and the electric terminal 22 is substantially reverse C-shaped in plan view. As shown in FIG. 20, the electric terminal 20 extends from one end of the electrical cable end of the printed circuit terminal board 18 and along the left side thereof, as viewed in FIG. 20, as indicated by the numeral 24, and to the opposite end thereof, as indicated by the numeral 26. The arcuate portion of the J-shape of the electric terminal 20 is indicated by the numeral 28. The portion of the electric terminal 20 adjacent the cable end of the printed circuit terminal board 18 is indicated by the numeral 30. As viewed in FIG. 20, the electric terminal 22 includes a right side portion 32 which extends between a cable end portion 36 and a portion 34 on the opposite end of the printed circuit terminal board 18.

As shown in FIG. 20, a first insulated electrical cable or conductor 38 is electrically and fixedly attached to the cable end portion 30 of the J-shaped electric terminal 20, by any suitable solder means, as for example, by silver solder, as indicated by the numeral 40 in FIG. 20. A second insulated electric cable or conductor 42 is electrically and fixedly secured to the cable end portion 36 of the reverse C-shaped terminal 22 by any suitable solder means, as by being silver soldered thereto, as indicated by the numeral 44. The electric terminals 20 and 22 are insulated from each other by the insulated areas indicated by the numerals 46, 48 and 50. The insulating area 46 comprises a longitudinal strip of suitable insulating material which spaces apart the ends 26 and 34 of the electric terminals 20 and 22, respectively. The insulating areas 48 and 50 insulate the rest of the adjacent areas, of the two electric terminals 20 and 22, from each other. The insulating material for the insulating areas 46, 48 and 50 may be deposited in their respective areas by any suitable means, and they are made equally level or co-planar with the conductive surfaces of the electric terminals 20 and 22 to provide a planar overall surface.

Figure 4:
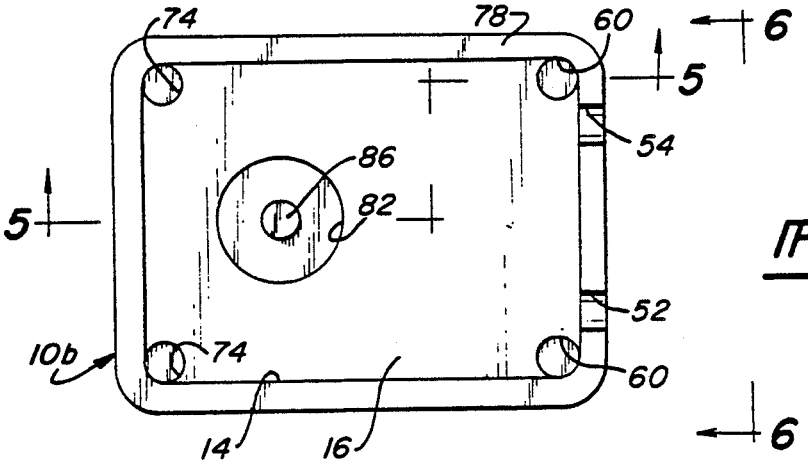
FIG. 4 is a horizontal section view of the switch structure illustrated in FIG. 3, taken along the line 4—4 thereof, and looking in the direction of the arrows.
Figure 5:
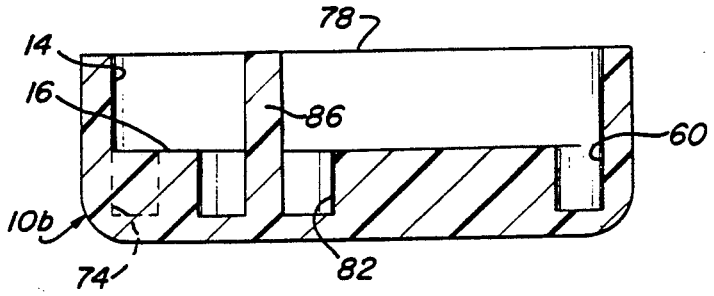
FIG. 5 is an elevation section view of the switch structure illustrated in FIG. 4, taken along the line 5—5 thereof, and looking in the direction of the arrows.
Figure 6:
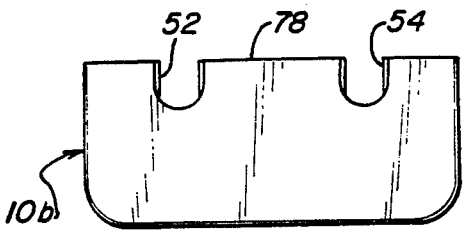
FIG. 6 is a right side view of the switch structure illustrated in FIG. 4, taken along the line 6—6 thereof, and looking in the direction of the arrows.

As shown in FIGS. 4, 6 and 20, the housing lower portion **10*b* is provided with a pair of laterally spaced apart U-shaped cable slots 52 and 54, which are formed in the wall of the cable end of the housing lower portion 10*b*. As shown in FIG. 20, when the printed circuit terminal board 18, with the electrical conductors or cables 38 and 42 attached, is mounted in the compartment 14, in the housing lower portion 10*b*, the electrical conductors or cables 38 and 42 are positioned in the cable U-shaped slots 52 and 54, respectively, in a press fit relationship, to assist in maintaining the printed circuit terminal board 18 in position in the housing recess 14. The printed circuit terminal board 18 is retained in the housing lower portion 10*b* against relative longitudinal movement by the press fits of the cables 38 and 42 in the U-shaped cable slots 52 and 54, respectively. The printed circuit terminal board 18 is made to predetermined longitudinal and transverse dimensions, so as to locate the printed circuit terminal board 18 in the housing recess 14 in a close fit with the wall surfaces thereof. The printed circuit terminal board 18 preferably fits within the recess 14, within a half of a millimeter clearance of each of the wall surfaces of the recess 14. The very close fit of the printed circuit terminal board 18 in the housing recess 14 functions with the press fit seating of the cables 38 and 42 in the cable slots 52 and 54, respectively, to center the printed circuit terminal board 18 in an operative position in the recess 14**.

Figure 7:
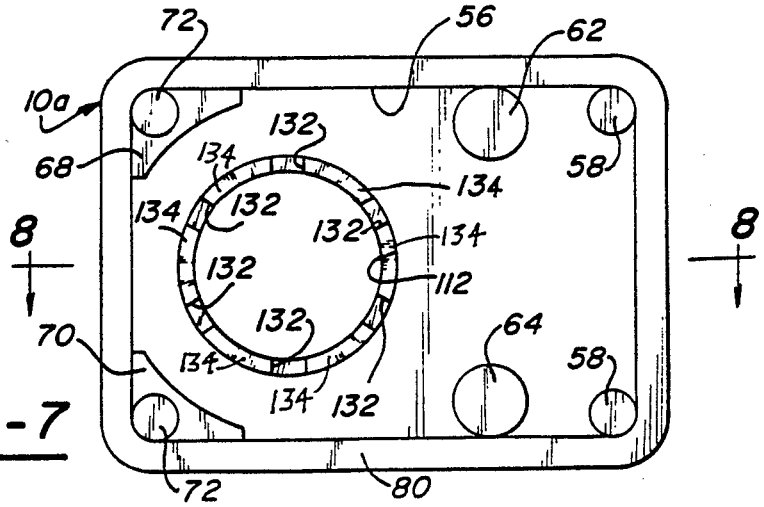
FIG. 7 is a horizontal section view of the switch structure shown in FIG. 1, taken along the line 7—7 thereof, with parts removed, and looking in the direction of the arrows.
Figure 9:
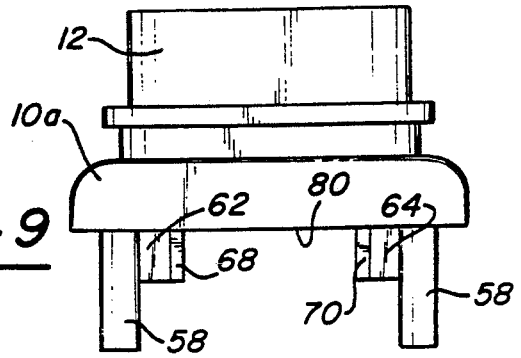
FIG. 9 is a right side elevation view of the switch structure illustrated in FIG. 8, taken along the line 9—9 thereof, and looking in the direction of the arrows.

As best seen in FIG. 7, the housing upper portion **10*a* is provided with a recess 56, in the lower end thereof. Integrally formed in the recess 56 is a pair of locating pins 58 at the cable end of the housing upper portion 10*a*. The locating pins 58 are disposed so as to seat in a pair of locating holes 60 (FIG. 4) in the cable end of the housing lower portion 10*b* when the housing portions 10*a* and 10*b* are assembled together (FIG. 3). As best seen in FIGS. 7 and 9, the housing upper portion 10*a* is provided in the recess 56 with a pair of integral, laterally spaced apart retainer posts or abutments 62 and 64. As illustrated in FIG. 3, when the housing upper and lower portions 10*a* and 10*b*, respectively, are in the assembled position, the lower end of each of the retainer posts or abutments 62 and 64 is seated against the printed circuit terminal board 18, to restrain it against movement perpendicular to the surface of the printed circuit terminal board 18. As best seen in FIG. 7, the housing upper portion 10*a* is provided with a pair of integral, laterally spaced apart retainer posts or abutments 68 and 70, which are mounted in the upper end housing recess 56, and which are disposed in the end corners opposite to the end corners in which the locating pins 58 are mounted. Integrally formed on the lower ends of the retainer posts or abutments 68 and 70 are a second pair of locating pins 72. The locating pins 72 are adapted to be operatively received in a pair of locating holes 74 (FIG. 4) in the housing lower portion 10*b* when the housing portions are assembled together (FIG. 3). As shown in FIG. 20, the corners of the printed circuit terminal board 18 are rounded inwardly to provide an arcuate recess 76 for the passage therethrough of the locating pins 58 and 72. As best seen in FIG. 4, the upper periphery edge of the housing lower portion 10*b* is provided with a flat surface 78 which is adapted to receive and be seated on the lower peripheral flat edge surface 80 (FIG. 3) when the upper and lower housing portions 10*a* and 10*b*, respectively, are assembled. The aforementioned housing portion surfaces 78 and 80 have applied thereto a suitable adhesive, such as an epoxy adhesive, before the said housing portions are assembled to each other so as to lock the housing portions 10*a* and 10*b*** together.

As shown in FIGS. 3–5, and 20, the housing lower portion **10*b* has formed in the bottom surface 16 of the compartment 14 a circular recess 82, which is formed on the longitudinal center line of the housing lower portion 10*b* and in a position spaced off-center, longitudinally toward the left end thereof, as viewed in FIG. 4. As shown in FIG. 3, the circular recess 82 in the housing lower portion 10*b* is aligned with a circular hole 84 (FIG. 20) in the printed circuit terminal board 18. As best seen, in FIGS. 3–5, a cylindrical shaft 86 is integrally formed in the circular recess 82, in the housing lower portion 10*b*, and it extends upwardly to a point substantially parallel to the peripheral upper end surface 78 of the housing lower portion 10*b***.

Figure 13:
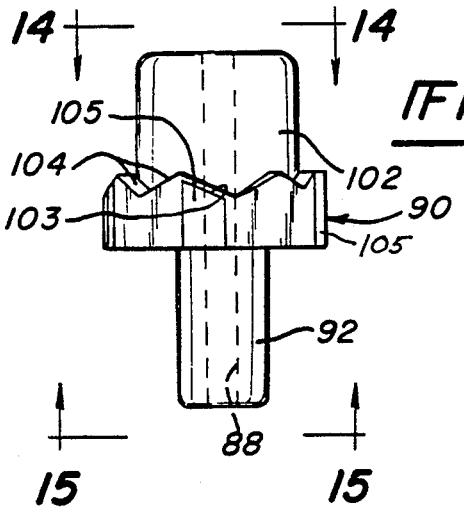
FIG. 13 is a side elevation view of a contact guide employed in the switch of the present invention.

As shown in FIGS. 3 and 20, the switch of the present invention includes a contact plate 96 which is illustrated as being circular in plan view. The contact plate 96 is made from any suitable electrically conductive material, as for example, brass, copper, steel or aluminum, and it is disposed co-planar with and adjacent to the top planar surface of the electric terminals 20 and 22, and the insulated material areas 46, 48 and 50, on the printed circuit terminal board 18. As best seen in FIG. 3, the cylindrical guide shaft 86 has its upper end slidably mounted in the lower end of an axial bore 88 which is formed through a contact guide and drive member, generally indicated by the numeral 90. As shown in FIGS. 3 and 13, the lower end of the contact guide and driver 90 includes a reduced diameter, integral downwardly extending shaft 92 which is of a non-circular cross section, and which is slidably mounted through a non-circular shaped opening 94 which is formed axially through the circular contact plate 96. As shown in FIG. 20, the axial hole 94, through the contact plate 96 is a six-sided non-circular opening through which is slidably mounted the six-sided outer periphery of the drive shaft 92.

As shown in FIGS. 16 through 19, the contact plate 96 has formed thereon, three contact members 98, which are spaced apart 120 degrees circumferentially from each other, around the periphery of the lower surface of the contact plate 96. The contact members 98 are rounded on their lower ends, and they are each formed by pressing the metal in the contact plate 96 downwardly with a round tool, to form a depression 100 on the upper side of the contact plate 96, and a dimple or hemispherical or ball shaped contact member 98 on the lower side of the contact plate 96. The contact members 98 are adapted to slide through a rotary path, over the co-planar surfaces of the electric terminals 20 and 22, and the insulating areas 46, 48 and 50. The contact members 98 establish electrical communication between the electric terminals 20 and 22 and the contact plate 96.

Figure 14:
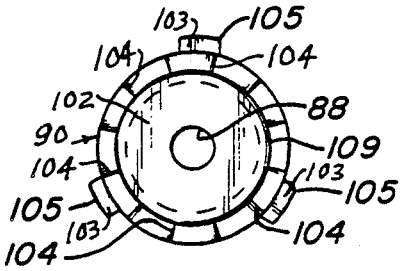
FIG. 14 is a top plan view of the contact guide illustrated in FIG. 13, taken along the line 14—14 thereof, and looking in the direction of the arrows.
Figure 15:
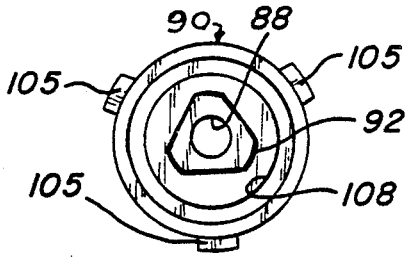
FIG. 15 is a bottom plan view of the contact guide illustrated in FIG. 13, taken along the line 15—15 thereof, and looking in the direction of the arrows.
Figure 16:
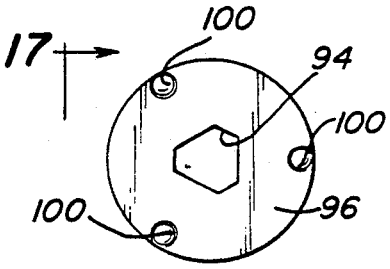
FIG. 16 is a top plan view of the contact plate employed in the switch of the present invention.
Figure 17:
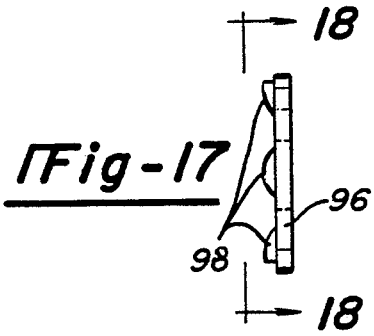
FIG. 17 is a side view of the switch contact plate illustrated in FIG. 16, taken along the line 17—17 thereof, and looking in the direction of the arrows.
Figure 18:
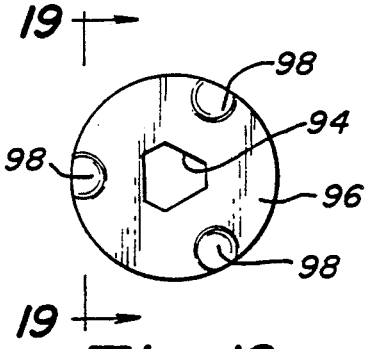
FIG. 18 is a bottom plan view of the switch contact plate illustrated in FIG. 17, taken along the line 18—18 thereof, and looking in the direction of the arrows.
Figure 19:
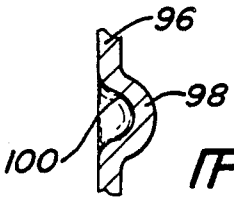
FIG. 19 is a fragmentary section view of the switch contact plate illustrated in FIG. 18, taken along the line 19—19 thereof, and looking in the direction of the arrows.

As shown in FIGS. 13 and 14, the contact guide and driver 90 has cylindrical upper end portion 102 which is formed to a larger diameter than the diameter of the contact plate drive shaft 92. The upper end of the drive shaft 92 is integral with the cylindrical upper end portion 102. Formed around the upper end of the drive shaft 92 and extending longitudinally upward from the lower end of the cylindrical upper end portion 102, of the contact guide and driver 90, is a circular recess 108 (FIGS. 3, 15) in which is operatively mounted the upper end of a coil spring 109. The coil spring 109 is telescopically mounted around the contact drive shaft 92, with the lower end of the spring being seated against the upper surface of the circular contact plate 96. The coil spring 109 maintains a downwardly biasing force on the circular contact plate 96 to maintain the contact members 98 in operative engagement with the co-planar surface of the printed circuit terminal board 18.

The switch of the present invention includes stepping means for rotating the contact guide and driver 90 to sequentially move the contact plate 96 through 60 degree steps, in a clockwise rotation. A stepping assembly which may be employed to provide the clockwise rotation of the contact guide and driver 90 is disclosed in the aforementioned U.S. Pat. No. 3,694,603, and the disclosure of the stepping system disclosed in said patent is incorporated herein by reference. The last mentioned stepping system is of the type which is capable of rotatably advancing a member in response to actuation of a push-button.

Figure 8:
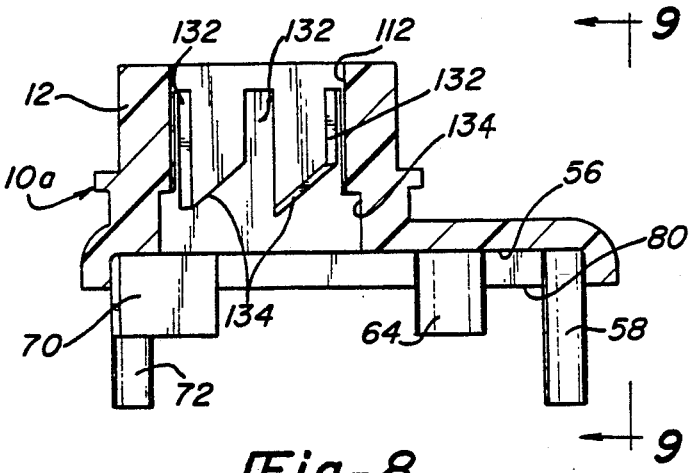
FIG. 8 is an elevation section view of the switch structure illustrated in FIG. 7, taken along the line 8—8 thereof, and looking in the direction of the arrows.
Figure 10:
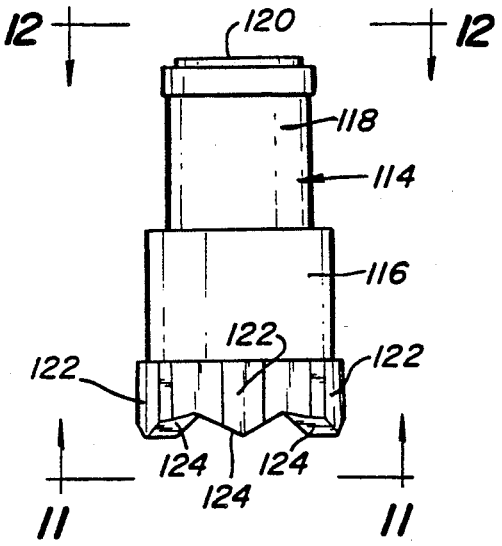
FIG. 10 is a side elevation view of the switch actuator button employed in the switch of the present invention.
Figure 11:
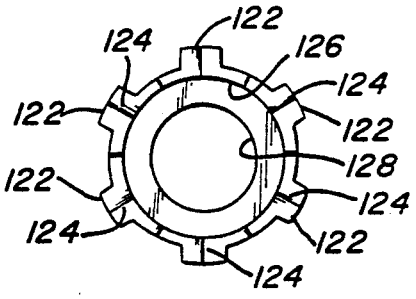
FIG. 11 is a bottom plan view of the switch actuator button illustrated in FIG. 10, taken along the line 11—11 thereof, and looking in the direction of the arrows
Figure 12:
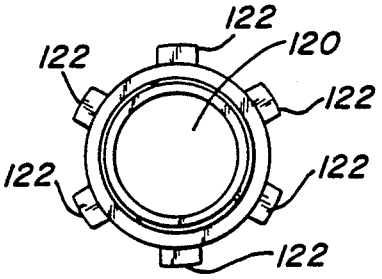
FIG. 12 is a top plan view of the switch actuator button illustrated in FIG. 10, taken along the line 12—12 thereof, and looking in the direction of the arrows.

FIGS. 3 and 7–15, illustrate the operation of a stepping assembly which may be employed to rotate the contact guide and driver 90 in the present invention. As shown in FIGS. 3 and 10, the stepping assembly includes a cylindrical actuator plunger, generally indicated by the numeral 114 (FIG. 10). The plunger 114 is telescopically mounted in the bore 112 in the switch housing upper portion 10*a*, and it includes an upper cylindrical portion 118 which is flat on the upper end thereof to form a push-button surface 120. The plunger upper portion 118 is integrally attached to a larger diameter cylindrical lower portion 116. As best seen in FIGS. 10 and 11, the plunger 114 has integrally formed on the lower end thereof, six circumferentially disposed and evenly spaced apart lugs 122, which each have formed thereon, on the lower end thereof a camming tooth 124. In FIG. 3, the numerals 126 and 128, designate the internal bores in the plunger lower and upper portions, 116 and 118, respectively. As shown in FIG. 8, the upper housing portion 10*a* has six longitudinal ways or grooves 132 formed on the inner surface of the bore 112 by six longitudinal camming ramps 134 which are formed in the bore 112. As shown in FIGS. 7 and 8, the camming ramps 134 protrude inwardly from the inner surface of the bore 112.

As shown in FIG. 13, the contact guide and driver 90 is provided on the lower end of the upper portion 102 with six upwardly facing camming teeth 104. As shown in FIG. 14, the camming teeth are evenly spaced circumferentially around the lower end of the cylindrical upper end portion 102 of the contact guide and driver 90. As shown in FIGS. 13 through 17, the contact guide and driver 90 is provided with three integrally formed latch dogs 105, which are also evenly spaced circumferentially around the camming teeth 104. The latch dogs 105 are disposed as shown in FIG. 13, in positions at alternate ones of the camming teeth 104. Each of the latch dogs 105 has the rear end of a saw tooth form, so as to define a camming ramp 103 which extends diagonally for the full width of each of the latch dogs 105.

As shown in FIG. 3, the upper cylindrical end 102 of the contact guide and driver 90 is slidably mounted in the lower end of the bore 126 in the lower end 116 of the plunger 114. The lugs 122 (FIG. 11) on the plunger 114 are slidably mounted in the longitudinal ways or grooves 132 (FIG. 8) (not shown in FIG. 3). The compression spring 109 biases or moves the contact guide and driver 90 upwardly, so that the camming teeth 124 (FIG. 10) on the lower end of the plunger 114 are meshed with the camming teeth 104 (FIG. 13) on the contact guide and driver 90. In the retracted or initial position shown in FIG. 3, the lugs 122 on the contact guide and driver 90 are also slidably mounted in the lower end of the longitudinal ways or grooves 132.

As shown in FIG. 8, the lower end of the camming ramps 134 are formed with diagonal shoulders. The outer diameter of the latch dogs 105 (FIG. 14) on the contact guide and driver 90 is greater then the inner diameter of the camming ramps 134, which are disposed on the inner surface of the cylindrical bore 112. When a force is exerted on the push-button surface 120, the plunger 114 and the contact guide and driver 90 are moved downward in a longitudinal or axial direction, due to the guiding action of the lugs 122 on the plunger 114 and the latch dogs 105 on the contact guide and driver 90. The last mentioned downward movement compresses the spring 109 and the shaft 92 in the lower end of the contact guide and driver 90 is slidably moved downward over the cylindrical shaft or stud 86 into the recess 82 in the switch lower housing portion 10*b*. When the downward force on the push-button surface 102 is released the compression in the spring 109 exerts an upward or return force on the contact guide and driver 90 and the plunger 114. As a result of the aforementioned differences in the inner diameters of the diagonal shoulders on the camming ramps 134, and the outer diameter of the latch dogs 105 on the contact guide and driver 90, when the latch dogs 105 are urged upwardly by the spring action, they engage the diagonal shoulders on the camming ramps 134 to effect rotary indexing of the contact guide and driver 90 to move the latch dogs 105 60 degrees to a new rotative position. The last mentioned camming action effects the rotation of the contact plate 96 to rotate it in a clockwise direction, as viewed in FIG. 20 to a new switched position.

As viewed in FIG. 20, the contact plate 96 is in a position wherein two of the contacts 98 are contacting the electric terminal 20 and one of the contacts 98 is contacting the electric terminal 22 to electrically connect the electric terminals 20 and 22 and to effect on "on" condition. When the aforedescribed stepping assembly is actuated to turn the contact plate 96 through another 60 degree rotative step, all three of the contacts 98 will be in contact with the electric terminal 20, to put the switch in an "off" condition. A succeeding stepping operation will provide a 60 degree rotative movement of the contact plate 96 to again move one of the contacts 98 back into a position as shown in FIG. 20, where in said one contact 98 is in contact with the electric terminal 22 and the other two contacts 98 will be in contact with the electric terminal 20, as shown in FIG. 20.

It will be seen, that at all times during operation of the switch of the present invention, that the circular contact plate 96 is always urged towards engagement with the planar surface of the printed circuit terminal board 18 by the action of the coil spring 109. This last described feature is not found in many of the prior art push-button switches in which an electrically conducting switch member is alternately raised and lowered from contact with one or more terminals, and optionally rotated when the conducting switch member is not in contact with the terminals. The printed circuit terminal board eliminates the need for extensive and fragile stamped metal terminals which are complex in design and due to their smallness, very difficult to secure in an operative position inside the switch housing. The printed circuit terminal board structure also eliminates the problem of wire detachment from a terminal in the switch housing. The extensive surface area between the circular contact plate 96 and the face of the printed circuit terminal board 18 provides a major reduction in the problem of milli-volt drop which is inherent in the prior art push-button designs due to the problem of loose terminals in the switch housing. The employment of the printed circuit terminal board 18 in the switch of the present invention increases the switch life and operating efficiency of the type of switches with which the invention is concerned. The printed circuit terminal board 18 also provides a push-button switch which requires a smaller number of components to fabricate the same, which results in further assembly efficiency and a significant cost reduction in the manufacturing of the various components employed and in the assembling of the same.

Figure 21:
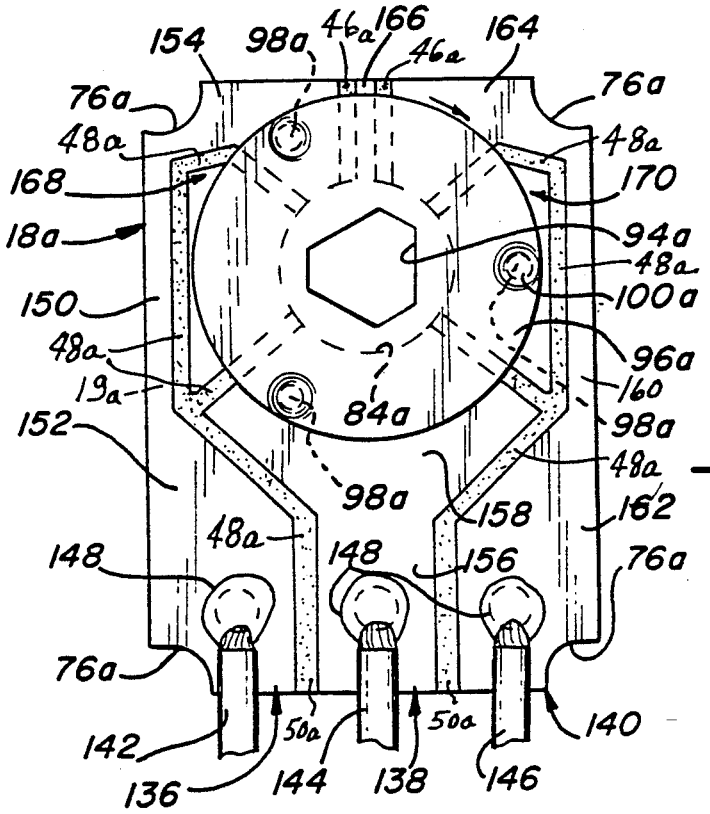
FIG. 21 is a top plan view of a three-wire printed circuit board made in accordance with the principles of the present invention, and showing a switch contact plate disposed thereover.

FIG. 21 illustrates a three-wire printed circuit terminal board, generally indicated by the numeral 18*a*. The parts of the printed circuit terminal board 18*a* which are the same or similar in structure and function to the corresponding parts in the first printed circuit terminal board embodiment of FIG. 20, have been marked with the same reference numerals followed by the small letter "*a*".

The three-wire printed circuit terminal board 18*a* includes three terminals identified generally by the reference numerals 136, 138 and 140. The numerals 142, 144 and 146 designate three conventional cables or conductors which are secured to the terminals 136, 138 and 140, respectively, by any suitable means, as by silver solder 148.

The terminals 136 is substantially C-shaped in plan view, as shown in FIG. 21, and it includes a portion 150 which is disposed along the left side of the base board 19*a* of the printed circuit terminal board 18*a*. The left terminal 136 includes a portion 152 which is adjacent to the cable end of the printed circuit terminal board 18*a*, and a portion 154 which is disposed at the other end of said board.

The terminal 138 is disposed centrally on the base board 19*a* and it includes a portion 156 which is adjacent the cable end of the printed circuit terminal board 18*a* and a centrally located portion 158 which combines with the portion 156 to form what appears to be a substantially Y-shaped terminal in plan view, as shown in FIG. 21. The third terminal 140 is disposed along the right side of the terminal base board 19*a*, as viewed in FIG. 21, and it includes a central portion 160 along the right side of said board, a portion 162 at the cable end of said board 19*a* and a portion 164 at the end of said board opposite to the cable end. The terminal 140 is substantially reverse C-shaped in plan view, as shown in FIG. 21. The ends 154 and 164 of the terminals 136 and 140, respectively, are divided by a conductive strip 166 which has a pair of strips of non-conductive or insulating material 46*a* on either side thereof.

The three cable, printed circuit terminal board 18*a* shown in FIG. 21 also includes two neutral areas 168 and 170 on the left and right sides of said board. The electrical terminals 136, 138 and 140, and the neutral or non-conductive areas 168 and 170 are all separated from each other by strips of insulating material designated by the numerals 48*a*. It will be understood that the entire surface of the printed circuit terminal board 18*a* has a single overall planar surface which is formed from the surfaces of the aforedescribed portions, whether insulating or electrically conductive.

The circular contact plate 96*a* is adapted to be rotated in a clockwise direction by the same rotating structure described for the printed circuit terminal board of FIG. 20. As shown in FIG. 21, the circular contact plate 96*a* is disposed so as to have the three conductive contacts 98*a* in a position such that the middle terminal 138, which is the "hot" terminal is electrically connected through the contacts 98*a* and the electrically conductive contact plate 96*a* to the left side terminal 136. When the electrically conductive contact plate 96*a* is rotated clockwise for 60 degrees, by the aforedescribed stepping and rotating means, the contacts 98*a* are slidably moved to a position whereby one of the contacts 98*a* would be disposed on the end 164 of the right terminal 140 and one of the contacts 98*a* would be disposed on the portion 158 of the terminal 138. The third contact 98*a* would be disposed on the neutral area 168. It will be understood that the neutral areas 168 and 170 are made from the same conductive material as is used in making the terminals 136, 138 and 140. It will be seen, that the three-wire printed circuit terminal board 18*a* is adapted for use in a push-button switch which successively energizes first the cable 142, then the cable 146, and then the cable 142, and so forth. There would not be an "off" position when using the printed circuit terminal board structure of FIG. 21. An "on/off" switch may be provided with the printed circuit terminal board 18*a* structure, shown in FIG. 21, by detaching either one of the outside cables 142 or 146. For example, with the cable 146 detached, and the contact plate 96*a* in the position shown in FIG. 21, the left terminal 136 would be electrically connected to the center "hot" terminal 138. When the contact plate 96*a* is rotated 60 degrees, the three contacts 98*a* would be positioned whereby one of the contacts 98*a* would be on the terminal end 164 of the terminal 140 from which the cable 146 had been disconnected. A second contact 98*a* would be on the neutral area 168, and the third contact 98*a* would be on the terminal 138, and the switch would be in an "off" position. Accordingly, it will be seen that successive "on and off" positions of the contact plate 96*a* could be effected by successive operations of the aforedescribed stepping and rotative means.

What is claimed is:

1. An electrical switch comprising:

(a) a housing having a compartment with an electrically insulating interior planar bottom surface;

(b) a printed circuit terminal board disposed in said housing on said planar surface and having an electrically insulating base board with a planar upper surface on which is electrolytically deposited at least first and second electrical terminals which have co-planar surfaces and which are spaced apart by co-planar insulating material deposited on said base board planar upper surface;

(c) a planar electrically conductive circular, rotatable contact plate having a plurality of circumferentially spaced apart plurality of contact members disposed in a first contact position over the printed circuit terminal board to electrically connect said at least first and second electrical terminals, and when the contact plate is rotated to a contact second position, said plurality of contact members electrically disconnect at least said first and second terminals; and, (d) a push-button stepping means operatively connected to said contact plate to sequentially rotate the contact plate to said first and second contact positions.

2. An electrical switch as defined in claim 1, wherein:

(a) said printed circuit board has a third electrical terminal electrolytically deposited on the base board planar upper surface which is co-planar with said first and second electrical terminals and spaced apart therefrom by co-planar insulating material deposited on said base board planar upper surface.

3. An electrical switch as defined in claim 1, wherein:

(a) said housing comprises an upper housing portion, and a lower housing portion in which is formed a compartment with said electrically insulating interior bottom surface;

(b) said compartment being provided with walls around said electrically insulating interior bottom surface; and, (c) said printed circuit terminal board is disposed on said bottom surface in said compartment in a close fit relationship with the walls of said compartment for centering said board in said compartment and restricting parallel movement of said board on said compartment bottom surface.

4. An electrical switch as defined in claim 3, wherein:

(a) said housing upper portion is provided with a plurality of internally mounted retainer posts which are integrally formed with said housing upper portion and which extend toward said housing lower portion, and the lower ends of said retainer posts being seated against the printed circuit terminal board when the housing upper portion is assembled onto the housing lower portion to restrict movement of said board in a direction perpendicular to said compartment interior bottom surface.

5. An electrical switch as defined in claim 4, wherein:

(a) said contact plate is provided with an axial, non-circular opening; and, (b) said stepping means includes a contact plate driver shaft having a non-circular cross section slidably mounted in said non-circular opening in the contact plate.

* * * * *

UNITED STATES PATENT OFFICE

CERTIFICATE OF CORRECTION

Patent No. 5,001,316 Dated March 19, 1991

Inventor(s) Mauricio Salaman

It is certified that error appears in the above-identified patent and that said Letters Patent is hereby corrected as shown below:

Column 7, line 4 - between "has" and "cylindrical" insert --a--.

Column 9, line 46 - delete "terminals" and insert --terminal--.

Signed and Sealed this

Eighth Day of September, 1992

*Attest:*

DOUGLAS B. COMER

*Attesting Officer*

*Acting Commissioner of Patents and Trademarks*